US005736919A

United States Patent [19]

Reeder

[11] Patent Number: 5,736,919

[45] Date of Patent: Apr. 7, 1998

[54] SPIRAL WOUND FUSE HAVING RESILIENTLY DEFORMABLE SILICONE CORE

[75] Inventor: Conrad M. Reeder, Glencoe, Mo.

[73] Assignee: Cooper Industries, Inc., Housten, Tex.

[21] Appl. No.: 600,363

[22] Filed: Feb. 13, 1996

[51] Int. Cl.[6] ..... H01H 85/30; H01H 85/143

[52] U.S. Cl. ..... 337/227; 337/206; 337/228; 337/241; 337/414

[58] Field of Search ..... 337/142, 158, 337/159, 162–166, 206, 207, 227, 228, 241, 273, 280, 295, 401–405, 414–416

[56] References Cited

U.S. PATENT DOCUMENTS

| | | | |
|---|---|---|---|
| 2,326,257 | 8/1943 | Schmidt et al. | 200/131 |
| 2,672,540 | 3/1954 | Dewey | 200/121 |
| 2,879,364 | 3/1959 | Mucher | 201/67 |
| 3,609,621 | 9/1971 | Danesi | 337/166 |
| 3,818,409 | 6/1974 | Pastors et al. | 337/273 |
| 3,845,439 | 10/1974 | Deelman | 337/291 |
| 4,020,441 | 4/1977 | Jacobs, Jr. | 337/187 |
| 4,057,774 | 11/1977 | Arikawa et al. | 337/164 |
| 4,122,426 | 10/1978 | Maruo | 337/163 |
| 4,177,444 | 12/1979 | Taki | 337/163 |
| 4,186,365 | 1/1980 | Fahnoe | 337/206 |
| 4,189,696 | 2/1980 | Beswick et al. | 337/232 |
| 4,297,666 | 10/1981 | Asdollahi | 337/163 |
| 4,409,729 | 10/1983 | Shah | 29/623 |
| 4,445,106 | 4/1984 | Shah | 337/163 |
| 4,517,544 | 5/1985 | Spaunhorst | 337/164 |
| 4,560,971 | 12/1985 | Oh | 337/164 |
| 4,603,315 | 7/1986 | Leong et al. | 337/243 |
| 4,680,567 | 7/1987 | Edwards | 337/164 |
| 4,736,180 | 4/1988 | Oh | 337/163 |
| 4,746,381 | 5/1988 | Parker et al. | 156/69 |
| 4,963,851 | 10/1990 | Okano et al. | 337/395 |
| 4,972,169 | 11/1990 | Kalra | 337/163 |
| 5,111,177 | 5/1992 | Krueger et al. | 337/243 |
| 5,142,262 | 8/1992 | Onken | 337/163 |

*Primary Examiner*—Leo P. Picard
*Assistant Examiner*—Jayprakash N. Gandhi
*Attorney, Agent, or Firm*—Burns, Doane, Swecker & Mathis, L.L.P.

[57] ABSTRACT

A spiral wound fuse includes an elongated housing, a supporting substrate formed of an electrically non-conducting, resiliently deformable, and flexible material, disposed in the housing, a fusible conductor wound around the supporting substrate and end caps mounted to the housing and connected to the conductor at the first and second ends of the supporting substrate. The fusible conductor may be impressed into the resiliently deformable substrate to form ridges of material between adjacent windings of the conductor. The ridges physically separate the windings and help to prevent arcing or bridging when the conductor melts to interrupt the circuit.

12 Claims, 1 Drawing Sheet

SPIRAL WOUND FUSE HAVING RESILIENTLY DEFORMABLE SILICONE CORE

FIELD OF THE INVENTION

The present invention is directed to electrical circuit protecting devices, and, more particularly, to circuit interrupting devices having a fusible element wound around a core of insulating material.

BACKGROUND AND SUMMARY

Conventional spiral wound fuses include a fuse wire wound around a core formed of ceramic fiber. The wire and core are placed in a tubular housing, and metal end caps are attached at opposite ends of the housing and connected to the corresponding ends of the wire. An example of such a fuse is described in U.S. Pat. No. 4,972,169 to Kalra.

In manufacture, the core is made by twisting several fibers together in a strand with sizing, a binder, added to hold the individual fibers together in the strand. The twisted strand assembly is then fired in an oven to remove the binder. Burning off the binder is necessary because the typical binder material carbonizes when the fuse wire melts during operation, and can conduct electricity, causing tracking of the fuse device. The fuse wire is wrapped around the core, and solder may be added at selected points. The wrapped core is then cut at the solder locations into lengths for individual fuse elements. The applied solder at end locations facilitates connecting the wire to the end caps of the finished assembly.

The ceramic core presents both manufacturing difficulties and high cost. The use of sizing-coated ceramic fibers requires the step of heating the core to remove the sizing. The ceramic material is abrasive and causes high wear to the tools for winding the wire on the core and also causes high wear of the cutting tools, both of which result in high maintenance costs. In addition, ceramic dust is thrown off the tool, which creates a health hazard for the cutting tool operator's eyes, lungs and skin.

Another deficiency in conventional spiral wound fuses is related to the operation of the fuse device in a circuit. When the fuse element melts, the melting fuse wire material and/or the metallic coating on the wire can form a short, thus reforming a current path and preventing the fuse from interrupting the circuit.

The present invention is directed to an improved spiral wound fuse that overcomes deficiencies in the art.

A spiral wound fuse according to the invention includes a substrate core formed of a material that is resiliently deformable and electrically insulating. According to a preferred embodiment of the invention, a substrate core material in accordance with the invention may comprise a silicone, silicone rubber or other resilient material. Other materials which have characteristics similar to silicones, for examples, elastomeric materials generally, are also suitable and the invention should not be construed as being limited to silicones. According to the invention, the substrate core material may be selected to have a hardness sufficient to support the fuse wire windings without breaking, stretching or splitting.

The substrate material according to the invention provides intimate contact with the fuse wire and thus acts to absorb heat from the fuse wire, which provides an increased time delay feature.

According to another aspect of the invention, the fuse wire wrapped around the core is impressed in the surface of the core to form grooves for the fuse wire and ridges of core material are correspondingly formed between adjacent windings, thus isolating each of the windings and helping to prevent arcing and/or short circuits when the fuse wire melts.

According to another aspect of the invention, a second, shunt wire may be included in the fuse device, the shunt wire being disposed on the core and extending between the opposite ends of the supporting core.

According to yet another aspect of the invention, the core material may include filler material, for example, an amount of glass fiber pieces or other stiffening material to provide stiffness to the core to prevent the core from sagging when positioned in the housing. Alternatively, or in addition, the supporting core material may be formed, by extrusion or another suitable method, around a centrally placed spine, which may be formed of glass fiber or another suitable material.

In addition, it has been found that the substrate core material reacts to the fuse melting by producing a coating on the surface of the housing, which provides a visual indication that the fuse has blown, facilitating identification of a blown fuse.

According to yet another aspect of the invention, a material that is arc-quenching, for example a silicate such as silica sand, fuller's earth, or another suitable material, may be added to the housing to fill space around the fuse wire.

The supporting core according to the invention is not abrasive and does not cause wear on the wire winding tool or the core cutting tool. In addition, the supporting core does not require firing to cure the material or remove a binding material, thus eliminating a step in the conventional manufacturing art.

BRIEF DESCRIPTION OF THE DRAWINGS

The invention may be better understood through the following description with reference to the appended drawings in which like components have been given the same reference character. In the drawings.

DETAILED DESCRIPTION

Figure 1:
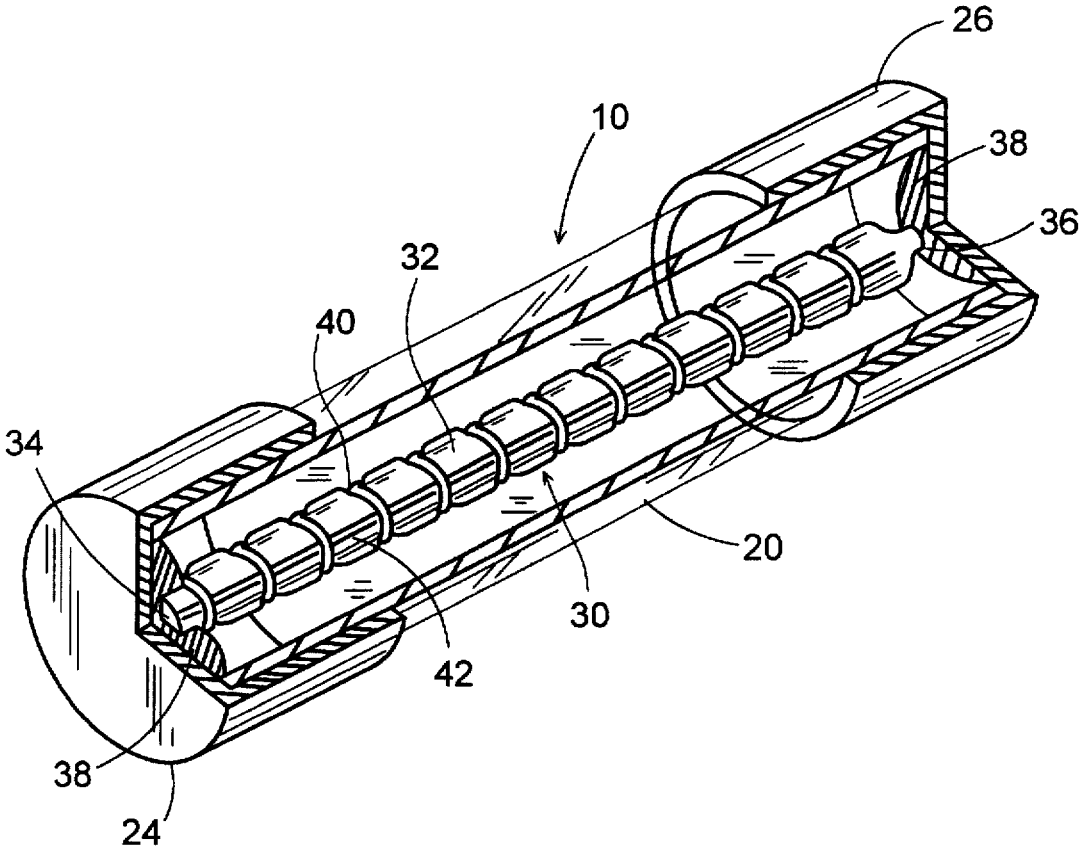
FIG. 1 is a perspective view, in section, of a fuse according to the present invention; and, FIG. 2 is a perspective view of a core and wound fuse element of the device of FIG. 1.

FIG. 1 is a perspective view, in section, of a fuse device 10 in accordance with the invention. The fuse device 10 includes a housing 20 and end caps 24, 26 closing the ends of the housing. The housing 20 as illustrated is a cylindrical, hollow tube that is open at opposite ends. According to a preferred embodiment, the housing is formed of glass or another transparent, electrically insulating material to permit inspection of the contents of the housing. Other insulating materials may also be used. The housing may be formed in a different shape, as the principles of the invention are not limited to a particular shape, and may be applied to different fuse structures.

The end caps 24, 26 are formed of an electrically conductive material, for example a metal alloy, to provide means for connecting the device 10 in an electrical circuit.

A fuse element 30 is disposed in the hollow space in the housing 20 and extends substantially the entire length of the housing. Opposing ends 34, 36 of the fuse element 30 are embedded in electrically conductive material plugs 38. The plugs 38 also help support the ends 34, 36 of the fuse element 30 to maintain it in position substantially centrally located in the housing. The fuse element 30 is connected by the plugs 38 to both of the end caps 24, 26, thus forming an electrically conductive path through the device 10.

The fuse element 30 comprises a core 32 formed of a resiliently deformable material that is electrically insulating. According to a preferred embodiment, the substrate core material comprises a silicone material, for example, a silicone rubber. Silicone can be easily colored with a dye, and the fuse formed with a core according to the invention may be color-coded according to rating for easy visual identification. Other suitable materials, for example, elastomeric materials, may also be selected.

A wire element 40 is wound around the core 32 from the first end 34 to the opposite second end 36. The wire element 40 is formed of an electrically conductive material and is formed to melt at a predetermined temperature to interrupt the electrical circuit in the event of an overload. The intimate contact between the wire element 40 and the core 32 provides good heat transfer from the wire to the core and results in an increased time delay feature compared to conventional designs using glass fiber cores.

Figure 2:
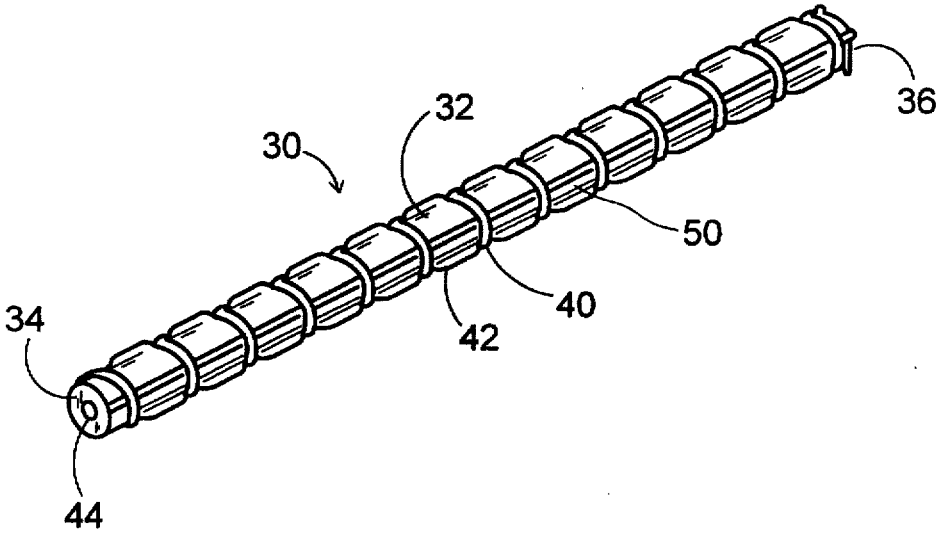

According to a preferred embodiment, shown in FIG. 2, the wire element 40 is disposed in grooves in the surface of the core 32 with ridges 42 of core material between adjacent windings. The ridges 42 provide physical barriers that at least partially separate the windings which helps to prevent arcing or bridging when the fuse wire melts to ensure interruption of the circuit. With an resilient material such as a silicone, the grooves and ridges can be formed during winding of the wire on the substrate core by impressing the wire into the surface of the core. Other methods of forming grooves and ridges, for example, by mechanically forming grooves in a cutting or shaping operation, or by braiding or winding the core material, may also be used.

The substrate core material, while being resilient, is also selected to have a hardness sufficient to support the wound fuse wire without breaking, stretching or splitting.

In addition, the core material is selected to have a structural stiffness sufficient to prevent sagging or bending when installed in the housing 20 and supported at the plugs 38. To increase stiffness, if necessary, an amount of stiffening material, for example glass fiber pieces or other suitable material, may be mixed in the core material. Alternatively, or in addition, the core may include a spine 44 around which the substrate material is formed, for example, by extrusion. The spine 44 may be formed of a glass fiber yarn, a Teflon® line, or other suitable material.

The fuse element 30 may also include a shunt 50, illustrated in FIG. 2. The shunt 50 is an electrically conductive wire element selected to melt at a predetermined temperature. The shunt 50 is disposed on the core 32 from end to end. The shunt 50 is positioned under the fuse wire 40 windings. The shunt 50 and the fuse wire 40 are therefore in contact at a plurality of locations along the core 32.

The fuse according to the invention may be made with or without a shunt 50 depending on the desired response for the fuse 10. For example, by using a shunt, a time delay may be built into the fuse response, as described in U.S. Pat. No. 4,680,567 to Edwards.

A fuse according to the invention can be made for higher current and voltage ratings than conventional spiral wound fuses. In addition, arc-quenching material such as silicate, for example, silica sand or another material such as fuller's earth, may be added to the housing to fill space around the fuse wire to increase the current rating of the fuse.

Silicone material has been found to form deposits on the housing when the fuse wire melts. This advantageously provides a visual indication that the fuse wire has been interrupted, which facilitates locating the blown fuse in a fuse panel, for example.

The foregoing has described the preferred principles, embodiments and modes of operation of the present invention; however, the invention should not be construed as limited to the particular embodiments described. Instead, the above-described embodiments should be regarded as illustrative rather than restrictive, and it should be appreciated that variations, changes, and equivalents may be made by others without departing from the scope of the present invention as defined by the following claims.

What is claimed is:

1. A spiral wound fuse, comprising:

a housing;

a supporting substrate disposed in the housing and being formed of an electrically non-conducting, resiliently deformable silicone material, and having a first end and an opposite second end;

a fusible conductor wound around the supporting substrate substantially from the first end to the second end, the conductor being impressed into an outer surface of the supporting substrate with substantially continuous ridges of substrate material separating adjacent conductor windings; and electrical connection means mounted to the housing and connected to the conductor at the first and second ends of the supporting substrate.

2. The spiral wound fuse as claimed in claim 1, wherein the housing is tubular shaped and transparent, and the supporting substrate is disposed along a longitudinal axis of the housing.

3. The spiral wound fuse as claimed in claim 1, wherein the supporting substrate is formed of silicone rubber.

4. The spiral wound fuse as claimed in claim 1, wherein the supporting substrate includes a predetermined amount of stiffening material.

5. The spiral wound fuse as claimed in claim 4, wherein the stiffening material is glass fiber.

6. The spiral wound fuse as claimed in claim 1, wherein the supporting substrate further comprises a centrally disposed spine to support the substrate.

7. The spiral wound fuse as claimed in claim 1, further comprising a second conductor disposed on the supporting substrate and connected to the electrical connection means at the first and second ends, the wound conductor contacting the second conductor at a plurality of locations.

8. The spiral wound fuse as claimed in claim 1, wherein the substrate core material is colored to indicate visually a fuse rating.

9. The spiral wound fuse as claimed in claim 1, wherein the substrate core material is a heat absorbing material.

10. The spiral wound fuse as claimed in claim 1, wherein the substrate core material forms a deposit on the housing upon melting of the fusible conductor.

11. The spiral wound fuse as claimed in claim 1, comprising an arc-quenching material in the housing surrounding the substrate core and conductor.

12. The spiral wound fuse as claimed in claim 11, wherein the arc-quenching material is a silicate.

* * * * *